US005820062A

United States Patent [19]

Menegatto

[11] Patent Number: 5,820,062

[45] Date of Patent: Oct. 13, 1998

[54] WINDING MACHINE

[75] Inventor: Carlo Menegatto, Milan, Italy

[73] Assignee: Menegatto S.r.l., Milan, Italy

[21] Appl. No.: 859,700

[22] Filed: May 21, 1997

[30] Foreign Application Priority Data

May 24, 1996 [IT] Italy ..... MI96A1061

[51] Int. Cl.[6] ..... B65H 54/28; D01H 13/00; F16H 29/02

[52] U.S. Cl. ..... 242/481.3; 57/99; 74/89.22; 74/110

[58] Field of Search ..... 242/35.5 R, 43 R, 242/158 R, 158 B, 481.3; 57/79, 99, 136; 74/89.22, 110

[56] References Cited

U.S. PATENT DOCUMENTS

| | | | |
|---|---|---|---|
| 1,239,669 | 9/1917 | Colman | 242/158 B X |
| 2,836,370 | 5/1958 | Drees et al. | 242/158 R |
| 3,402,898 | 9/1968 | Mattingly | 242/43 R |
| 3,796,383 | 3/1974 | Sartori | 242/43 R |
| 4,034,934 | 7/1977 | Hardwick | 242/158 B |
| 4,657,205 | 4/1987 | Sugioka | 242/35.5 R X |
| 4,681,275 | 7/1987 | Honczarenko | 242/158 B X |
| 4,955,552 | 9/1990 | Menegatto | 242/35.5 R |

FOREIGN PATENT DOCUMENTS 0 424 573 5/1991 European Pat. Off. .

*Primary Examiner*—Michael Mansen
*Attorney, Agent, or Firm*—Young & Thompson

[57] ABSTRACT

A winding machine having yarn guides for guiding the yarn on a bobbin, mobile supports for supporting each yarn guide, and a driver for imparting reciprocating backward and forward motion to the yarn guides. The driver includes a continuous linear element to which supports for the yarn guides are attached, and a drive rod having a longitudinal axis and which moves reciprocatingly in the direction of the axis. The drive rod is attached to the continuous linear element and thereby drives the yarn guides connected thereto in a reciprocating motion to distribute the yarn on the respective bobbin.

14 Claims, 3 Drawing Sheets

WINDING MACHINE

TECHNICAL FIELD

The present invention relates to a winding machine.

More particularly the present invention aims at providing an improvement for a winding machine of the type described in the European Patent EP-B1-0-424573.

BACKGROUND ART

The winding machine described in this European Patent substantially comprises a structure for supporting a spindle-holder frame provided with two rows of vertical spindles supported rotatingly and longitudinally aligned on the two sides or on the two faces of the machine, wherein each individual spindle of the known winding machine has a respective bobbin for winding of the yarn passing through a respective yarn guide with the function of evenly and alternatively distributing yarn along the whole length of the bobbin.

Moreover, in the known winding machine, each mobile part for supporting the yarn guide is in turn connected to a reciprocating drive system by means of individual parts for transmission of motion connected to a common drive shaft, which oscillates in rotation for a preset angle of amplitude to make the yarn guide perform the whole work stroke. The rotating drive shaft extends longitudinally for the whole length of the winding machine, placing itself below the spindle-holder frame, while the supports relating to each pair of spindles on the two opposite faces of the machine are connected to a common transmission part, in the form for example of a cable or the like, which is wound on a respective central pulley integral and coaxial with the oscillating shaft, and on transmission wheels placed above the spindle-holder frame in such a way that each transmission part is placed transversely to the machine and surrounds the respective pair of spindles.

In the winding machine mentioned, for each pair of opposing spindles, each belonging to one of the two parallel rows of spindles, there is therefore a flexible transmission cable lying on a plane transverse to the longitudinal axis of the machine.

SUMMARY OF THE INVENTION

With the present invention it is aimed to provide an improved winding machine which allows a further improvement on the already admirable results achieved with the known winding machine mentioned above.

More particularly, the object of the present invention is that of providing a winding machine having an extremely fast speed of winding yarn on the bobbins, higher than the already high speed obtained hitherto with the winding machines known to date.

A further object of the present invention is therefore that of providing a winding machine having a precision of winding the yarn on the bobbins which is even more accurate compared to that already obtained with the winding machines of the type currently known. Another object of the present invention is that of providing a winding machine whereby it is possible to obtain a very short assembly time of the machine, as well as a low weight in view of easy transport of the same.

The previous objects are achieved, by providing a winding machine of the type comprising a support framework for a spindle-holder frame extending longitudinally and provided with at least a plurality of spindles supported rotatingly and longitudinally aligned on the frame itself, the winding machine also comprising a respective element for guiding the yarn which is wound on at least one bobbin associated with each individual spindle; mobile means for supporting each yarn guide; means for guiding said mobile means for supporting the yarn guides, and means for driving the reciprocating backward and forward motion of the means for supporting the yarn guides, comprising at least one continuous linear flexible element wherewith said supports for the yarn guides are made integral by means of respective attachment means, characterized in that said means for driving the reciprocating backward and forward motion of the means for supporting the yarn guides also comprise a drive rod having a longitudinal axis and moving reciprocatingly in the direction of said axis; and in that attachment means are provided for fixing said mobile drive rod to said continuous linear element and for driving the latter and the yarn guides connected thereto in a reciprocating motion of distributing yarn on the respective bobbin.

Said drive rod, which is driven in a reciprocating rectilinear motion in the direction of its own longitudinal axis, is subjected practically only to alternate compression actions, i.e. to a regime of stresses which are easy to withstand even with a somewhat small section of the rod.

As a result said drive rod can be made with extremely low weight and small geometrical dimensions and thus, due to the reduction in the inertia involved, it is possible to achieve particularly high working speeds, as also obtain highly accurate and prompt braking of the drive shaft during changes of direction of running, leading to an extremely accurate stroke of the yarn guide and bobbins of particularly precise manufacture.

BRIEF DESCRIPTION OF THE DRAWINGS

The present invention will in any case be made clearer on reading the following description, relating to a preferred embodiment of the invention, to be read with reference to the accompanying drawings, in which.

DESCRIPTION OF THE PREFERRED EMBODIMENT

Figure 1:
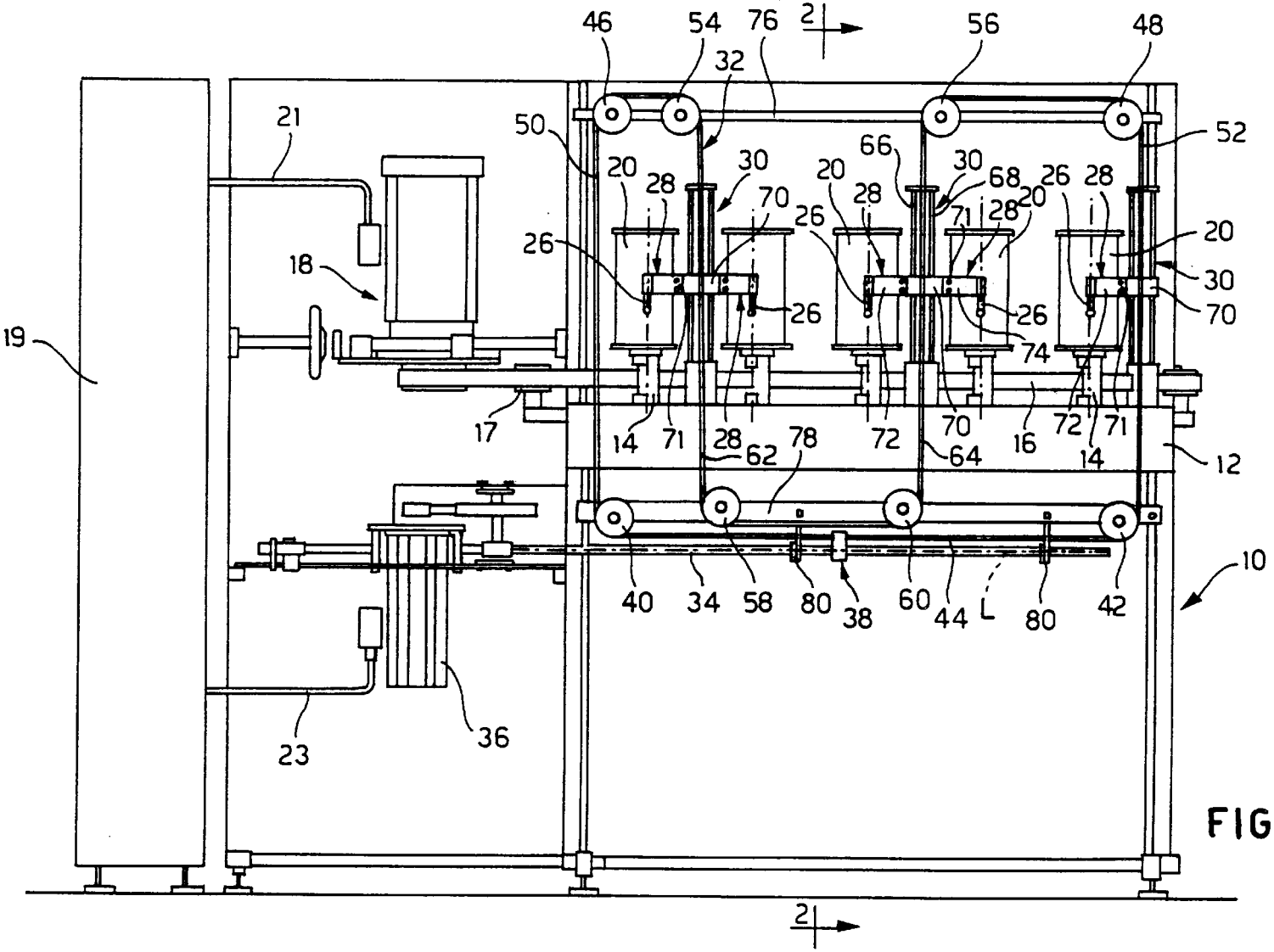
FIG. 1 is a side view of the preferred embodiment of a winding machine according to the present invention.
Figure 2:
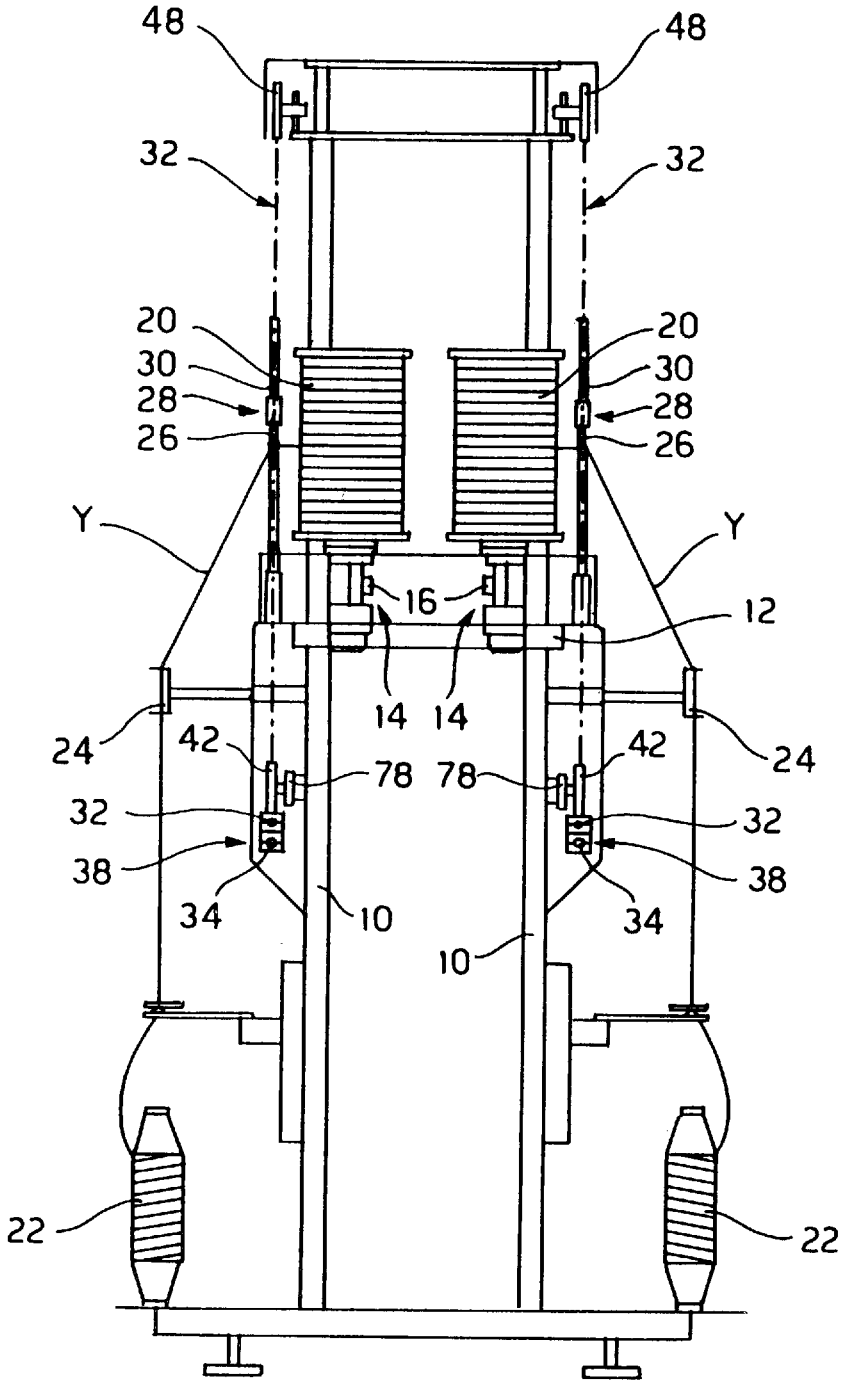
FIG. 2 is a sectioned view, taken along line 2—2 of FIG. 1, of the preferred embodiment of a winding machine according to the present invention.
Figure 3:
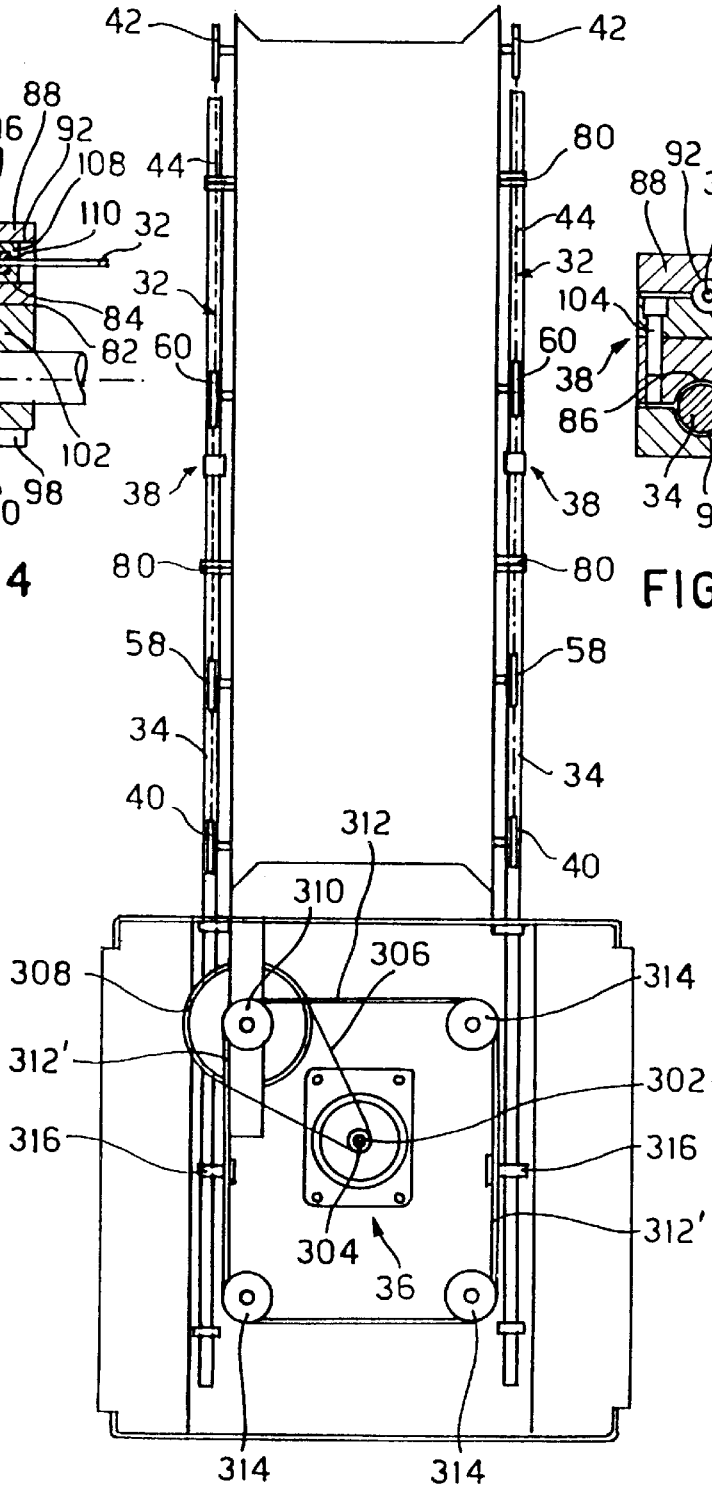
FIG. 3 is a view from below illustrating the system of driving actuation of the drive rods of the yarn guides of the preferred embodiment of a winding machine according to the present invention.

As shown in FIGS. 1, 2 and 3, the winding machine substantially comprises a structure 10 for supporting a spindle-holder frame 12 provided with two rows of vertical spindles 14 supported rotatingly and longitudinally aligned on the two sides or on the two faces of the machine.

The spindles 14 on the two sides are driven to rotate simultaneously by means of a tangential drive system comprising an endless belt 16 actuated by a motor 18 and maintained taut by a tightener roller 17.

At the end of the winding machine a head 19 is provided for the electric drive devices wherefrom electrical connections 21 and 23 extend for the electric motors of the winding machine.

20 denotes in FIGS. 1 and 2 the bobbins, arranged on each individual spindle 14, for winding the yarn Y which is taken up or unwound by a respective underlying reel 22.

The yarn Y which is unwound from the reels 22 passes through a respective thread tightener 24 which acts to maintain the yarn with the required winding tension, then the yarn Y passes through a yarn guide part 26 having the function of evenly and alternatively distributing the yarn along the whole length of the bobbin 20.

Each yarn guide 26 is attached to a respective mobile support part 28 restrained to move along a perfectly rectilinear and vertical path by means of a guide 30 placed parallel to the respective spindle 14, on the external side of the frame 10 of the machine.

According to the invention, the winding machine comprises for each row of winding spindles 14 a rod 34 for driving the reciprocating backward and forward motion of the means for supporting the yarn guides, which rod 34 has a longitudinal axis L and moves reciprocatingly, actuated by a suitable motor 36, in the direction of said axis L to perform movements of a predetermined amplitude, sufficient for making the yarn guides 26 perform the whole working stroke.

The mobile parts for supporting the yarn guides 26 of each row of spindles 14 are connected to the respective reciprocating drive rod 34 by means of a corresponding transmission part in the form for example of a cable or wire 32, or another equivalent flexible continuous linear element, which is connected to the respective drive rod 34 in one single point of the same by means of a single joining block 38.

As shown, in a preferred manner, said drive rods 34 extend longitudinally to the winding machine, in a position below the frame 12 of the spindles, and are situated on the external opposite sides of the winding machine.

The winding machine of the invention comprises further respective support and guide means for each of said continuous flexible transmission elements 32, in the form of a plurality of transmission wheels peripherally whereto said continuous transmission element 32 runs. Said transmission wheels are positioned at the opposite external sides of the winding machine in such a way as to place said continuous linear flexible element 32 entirely on the external side of the winding machine. This allows easier assembly by operators with a saving in working times and labor.

In fact in the winding machine according to the prior art, assembly of the cables on the machine required staff to work in a bent and uncomfortable position below the spindle-holder frame and also required the presence of at least two operators on both sides of the machine, or even one single operator who was nevertheless obliged to perform continuous movements from one side to the other of the machine to mount the cable adequately on the guide rollers, with a considerable waste of labor and working times.

With the system of supporting and guiding of the continuous linear element of the present invention, a single operator can therefore advantageously mount the cable on the transmission and sliding wheels while always remaining on the same side of the winding machine. Thus a reduction in labor and assembly times of the winding machine is achieved.

More particularly said support and guide parts for said continuous linear elements 32 have respectively at least a first and a second transmission wheel or part 40, 42 which are placed, below the frame 12 for the spindles, parallel to and near said drive rod 34 in order to arrange a branch 44 of said linear flexible transmission element 32 parallel to and near said drive rod 34.

Said support and guide means also comprise at least a third and a fourth transmission part 46, 48 placed vertically aligned to said first and to said second transmission part 40, 42 respectively in a position above said winding spindles, to define with said wheels 40, 42 respectively a first and a second vertical branch 50, 52 for attachment of said support means of the yarn guide elements.

For the guide and support of each of said continuous flexible elements 32 a fifth and a sixth upper sliding and transmission element 54, 56 are also provided, situated above said spindles 14 in an intermediate position between said third and fourth transmission parts 46,48 and, in a position below said frame 12 for the spindles, a seventh and eighth transmission part 58, 60 are also provided, vertically aligned respectively with said fifth and said sixth transmission parts 54, 56, in such a way as to define a third and fourth vertical branch 62, 64 for attachment for the means 28 for supporting the yarn guide elements.

The transmission wheels for said cable or continuous linear element 32 are fixed, freely rotating in a vertical-longitudinal plane, to the frame of the winding machine in particular on the end side of lateral longitudinal members 76, 78.

Such an arrangement for the transmission cable 32 allows said cable to drive simultaneously a considerable quantity of yarn guides 26. Moreover, since said transmission cable is easy and fast to install on the machine, the winding machine can be made fully operational in a very short time.

Naturally it could also be foreseen for the present invention to use further transmission wheels for providing the transmission cable with additional vertical branches suitable for driving additional winding yarn guides, thus further increasing the number of bobbins which can be wound with the use of a single cable, as also the fact of using, for each individual row of spindles, a plurality of aligned cables, lying on the same vertical-longitudinal plane, each suitable for serving a certain quantity of spindles of the row, wherein each cable is individually attached to the respective drive rod.

As can be seen in FIG. 1, each of said lower lateral longitudinal members 78 are also attached, in an axially sliding manner, to said drive rods 34 via suitable support and guide brackets 80, which allow the length of free lateral inflexion of the drive rod 34 to be reduced, further reducing the stress rate of the latter.

According to a further advantageous feature, each of said support branches of the yarn guides of the respective continuous linear element 32 is placed in an intermediate position to a respective pair of adjacent spindles 14 of the same row of spindles, in such a way as to allow support of a yarn guide pair 26, each intended for a respective spindle 14.

Each of said vertical branches of the cable whereto the supports 28 of the yarn guides are attached is also situated in an intermediate position to a respective first and second parallel guide stems 66, 68 suitable for guiding with precision said yarn guides 26 along a perfectly rectilinear and vertical route.

Said guide means 30 for the supports 28 of the yarn guide are also placed in a position intermediate to pairs of longitudinally adjacent winding spindles 14.

The support 28 of the yarn guides 26 comprises a slider 70, sliding on the guide stems 66, 68, wherefrom respective small rods 72, 74 for supporting the yarn guides extend in opposite longitudinal directions, having one end attached to said slider 70 and supporting at the other end a respective yarn guide 26.

In this way it is therefore possible, by means of a single vertical branch of the cable, to provide for winding of the two bobbins simultaneously.

Said small rods 72, 74 for supporting the yarn guide are engaged with said slider 70 removably by means of a suitable engaging screws 71, in such a way that if necessary, for example in the case of an end spindle, only one single small support rod for a respective yarn guide can be engaged with the slider 70 and a single yarn guide 26 can thus be guided.

According to a further advantageous feature of the present invention, each of said drive rods 34 is attached to the respective flexible continuous linear element 32 thanks to a single joining block 38.

Figure 4:
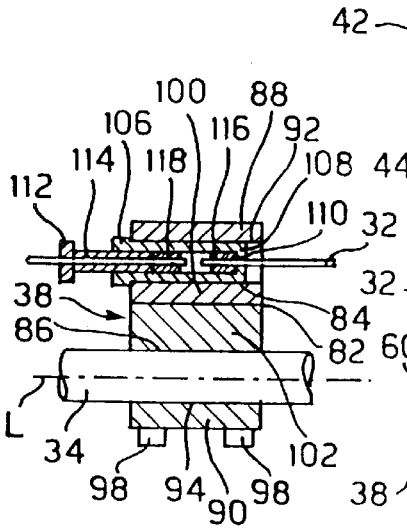
FIG. 4 is a longitudinal sectioned view relating to the joining block between the drive rod and the transmission cable of the preferred embodiment of a winding machine of the present invention.
Figure 5:
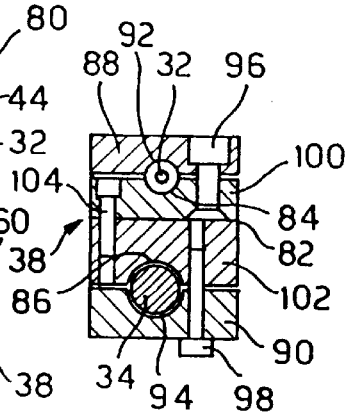
FIG. 5 is a transverse sectioned view relating to the joining block of FIG. 4.

As shown in FIGS. 4 and 5, said joining block 38 has a central body 82, having, on two opposite faces, respectively a first and a second groove 84, 86, defining corresponding portions of housings for, respectively, said flexible continuous linear element 32 and said drive rod 34, as well as comprising a first and a second locking plate 88, 90 having respective grooves 92, 94 defining correspondingly the remaining parts of said housings for the cable 32 and for the drive rod 34.

Screws 96, 98 are provided respectively for tightening said first and said second locking plates 88, 90 to said central body 82 so as to engage said plates 88, 90 respectively against said flexible continuous linear element 32 and said drive rod 34 and allow reciprocal tight locking between the same.

It is therefore an extremely rapid and easy system of hooking between the rod and cable.

As can be seen, the central body can also be divided into two portions 100, 102, restrained firmly in contact by means of at least one screw 104.

In an advantageous manner provision is also made for an element for retaining the ends of the cable or wire 32 in the form of a hollow bush 106 holding internally the ends of said flexible continuous linear element 32 and which can be engaged externally between said first plate 88 and said central body 82 of said attachment block 38.

The bush 106 has in particular a back wall 108 having a hole 110 and housing internally, at the other end, a small mobile cylinder 112, also having a hole 114 in the center, both said holes being provided to allow passage of the ends of the cable or flexible continuous linear element inside the bush 106.

In order to allow the ends of the cable 32 to be restrained inside the bush 106, said ends of the cable have been provided with retainer blocks 116, 118 with a diameter greater than that of the holes of said backwall 108 and of said small cylinder 112.

Such an attachment system allows rapid and easy attachment of the cable to the attachment block 28.

Said small mobile cylinder 112 also allows, by engaging by threading with said bush 106, regulation of the tightness of the cable.

With reference in particular to FIGS. 1, 2 and 3, it can be seen how reciprocating actuation of the drive rods 34 of the winding machine by the common motor 36 is performed via a transmission system comprising a first pulley 302 associated with the shaft 304 of the motor 36, which pulley 302 transmits, via a transmission belt 306, the motion of the drive shaft, to a further pulley of larger diameter 308 in turn integral in rotation with a pulley 310 of smaller diameter and suitable for actuating a drive belt 312. Said drive belt 312 is arranged according to a quadrangular configuration thanks to a further three transmission rollers 314 arranged with said actuating pulley 310 at the top of a quadrilateral.

The external longitudinal branches 312' of said actuation belt 312 are attached, by respective clamps 316, to the respective drive rod 34.

The reciprocating rotation of the shaft of drive motor 36 provides for the reciprocating motion of the drive rods 34 and hence of the yarn guides 26 of the winding machine.

Thus a new winding machine has been provided whereby it is possible to obtain fast and accurate production of bobbins of yarn, as also easy and rapid assembly of the machine itself.

It must naturally be understood that what has been written and shown in reference to the preferred embodiment of the present invention has been given purely by way of a non-limiting example of the principle claimed.

What is claimed is:

1. A yarn winding machine for an apparatus having plural longitudinally aligned bobbins, said yarn winding machine comprising:

plural yarn guides, each of said yarn guides for guiding yarn onto a separate bobbin;

a mobile support for at least one of said yarn guides;

a mobile support guide for guiding movement of said mobile support; and a driver for moving said mobile support to position said at least one of said yarn guides, said driver comprising a drive rod with a longitudinal axis, a continuous linear element having a first portion attached to said drive rod and a second portion attached to said mobile support, and a motor for imparting a reciprocating longitudinal motion to said drive rod, whereby a reciprocating movement is imparted to said continuous linear element.

2. The yarn winding machine of claim 1, further comprising supports and guides for said continuous linear element.

3. The yarn winding machine of claim 2, wherein ones of said supports and guides align said first portion of said continuous linear element parallel to said longitudinal axis throughout a range of longitudinal motion of said drive rod.

4. The yarn winding machine of claim 2, wherein said mobile support is generally perpendicular to said longitudinal axis, and wherein ones of said supports and guides align said second portion of said continuous linear element parallel to said mobile support throughout a range of longitudinal motion of said drive rod.

5. The yarn winding machine of claim 1, wherein said mobile support supports two of said yarn guides that extend in opposite directions from said mobile support.

6. The yarn winding machine of claim 1, wherein said mobile support comprises two parallel guide stems for slidably guiding said at least one of said yarn guides.

7. The yarn winding machine of claim 1, further comprising a joining block for attaching said continuous linear element to said drive rod, said joining block comprising a central body with grooves on opposite sides for receiving said continuous linear element and said drive rod, two locking plates, one of said locking plates for holding said continuous linear element in one of said two grooves and the other of said locking plates for holding said drive rod in the other of said two grooves, and releasable tighteners for holding said locking plates against said central body.

8. The yarn winding machine of claim 7, wherein said joining block further comprises a hollow bushing for holding said continuous linear element.

9. The yarn winding machine of claim 1, wherein said continuous linear element comprises one of a cable and a wire.

10. A yarn winding machine comprising:

a longitudinally extended spindle holder frame;

plural spindles rotatingly supported and longitudinally aligned adjacent one side of said frame;

plural bobbins, each of said bobbins being associated with one of said spindles;

plural yarn guides, each of said yarn guides for guiding yarn onto a separate one of said bobbins;

plural mobile supports, each of said mobile supports for supporting at least one of said yarn guides;

plural mobile support guides, each of said support guides for guiding movement of a respective one of said mobile supports; and a driver for moving said mobile supports to position respective ones of said yarn guides, said driver comprising a drive rod with a longitudinal axis, a continuous linear element having a first portion attached to said drive rod and second portions attached to respective ones of said mobile supports, and a motor for imparting a reciprocating longitudinal motion to said drive rod, whereby a reciprocating movement is imparted to said continuous linear element to distribute yarn onto respective ones of said bobbins.

11. The yarn winding machine of claim 10, further comprising:

plural second spindles rotatingly supported and longitudinally aligned adjacent a second side of said frame;

plural second bobbins, each of said second bobbins being associated with one of said second spindles;

plural second yarn guides, each of said second yarn guides for guiding yarn onto a separate one of said second bobbins;

plural second mobile supports, each of said second mobile supports for supporting at least one of said second yarn guides;

plural second mobile support guides, each of said second support guides for guiding movement of a respective one of said second mobile supports; and a second driver for moving said second mobile supports to position respective ones of said second yarn guides, said second driver comprising a second drive rod with a longitudinal axis, a second continuous linear element having a first portion attached to said second drive rod and second portions attached to respective ones of said second mobile supports, said motor for imparting a reciprocating longitudinal motion to said second drive rod, whereby a reciprocating movement is imparted to said second continuous linear element to distribute yarn onto respective ones of said second bobbins.

12. The yarn winding machine of claim 11, further comprising a transmission for imparting reciprocating movement to said drive rods, said transmission comprising two pairs of transmission rollers, each aligned with a path of motion of one of said drive rods, a belt wound around said two pairs of transmission rollers to impart motion thereto, and a pulley for transferring motion from said motor to said belt.

13. The yarn winding machine of claim 10, wherein said drive rod is generally parallel to said one side of said frame adjacent said one side.

14. The yarn winding machine of claim 10, wherein said continuous linear element is guided longitudinally near exterior edges of said frame and is guided laterally exterior to said frame between pairs of said bobbins, each of said second portions being between a respective one of said pairs of said bobbins.

* * * * *